US010370210B2

(12) United States Patent
Morita

(10) Patent No.: US 10,370,210 B2
(45) Date of Patent: Aug. 6, 2019

(54) SHEET CONVEYER AND IMAGE FORMING APPARATUS

(71) Applicant: Brother Kogyo Kabushiki Kaisha, Nagoya-shi, Aichi-ken (JP)

(72) Inventor: Tetsuya Morita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/817,947

(22) Filed: Nov. 20, 2017

(65) Prior Publication Data

US 2018/0162672 A1 Jun. 14, 2018

(30) Foreign Application Priority Data

Dec. 14, 2016 (JP) ..... 2016-242538

(51) Int. Cl.

| | |
|---|---|
| ***B65H 5/38*** | (2006.01) |
| ***B65H 29/12*** | (2006.01) |
| ***B65H 29/52*** | (2006.01) |
| ***B65H 1/04*** | (2006.01) |
| ***B65H 31/02*** | (2006.01) |
| ***B65H 3/06*** | (2006.01) |
| ***B65H 9/16*** | (2006.01) |
| ***G03G 15/23*** | (2006.01) |

(Continued)

(52) U.S. Cl.

CPC ..... *B65H 5/38* (2013.01); *B65H 1/04* (2013.01); *B65H 3/06* (2013.01); *B65H 9/16* (2013.01); *B65H 29/125* (2013.01); *B65H 29/52* (2013.01); *B65H 31/02* (2013.01); *B65H 85/00* (2013.01); *G03G 15/23* (2013.01); *B65H 2301/331* (2013.01); *B65H 2402/46* (2013.01); *B65H 2404/61* (2013.01); *B65H 2801/03* (2013.01); *G03G 15/6529* (2013.01); *G03G 2215/00696* (2013.01)

(58) Field of Classification Search

CPC .. B65H 9/106; B65H 9/166; B65H 2301/331; B65H 5/38; B65H 2404/61

USPC ..... 271/251

See application file for complete search history.

(56) References Cited

U.S. PATENT DOCUMENTS 6,993,282 B2 * 1/2006 Kimizuka ..... B65H 9/166 399/401

7,810,809 B2 * 10/2010 Inui ..... B65H 9/166 271/248

(Continued)

FOREIGN PATENT DOCUMENTS

JP H08-143233 A 6/1996

JP 2012-096862 A 5/2012

*Primary Examiner* — Michael C McCullough

(74) *Attorney, Agent, or Firm* — Banner & Witcoff, Ltd.

(57) ABSTRACT

A sheet conveyer to shift a sheet at one side of the sheet conveyer in a widthwise direction is provided. The sheet conveyer includes a pair of rollers, a regulative guide arranged at a position closer to the one side than the pair of rollers in the widthwise direction, a first guide arranged at a position upstream from the pair of rollers with regard to a conveying direction to contact a first area on a first face of the sheet at a position closer to the one side in the widthwise direction than a widthwise center of the sheet, and a second guide arranged at a position upstream from the pair of rollers with regard to the conveying direction to contact a second area on a second face of the sheet. The second guide partly overlaps the first guide in a direction of height.

8 Claims, 10 Drawing Sheets

(51) Int. Cl.
*B65H 85/00* (2006.01)
*G03G 15/00* (2006.01)

(56) References Cited

U.S. PATENT DOCUMENTS

| | | | | |
|---|---|---|---|---|
| 8,393,619 | B2 * | 3/2013 | Iwamoto | G03G 15/6505 271/251 |
| 8,447,223 | B2 * | 5/2013 | Inui | G03G 15/232 271/248 |
| 8,534,668 | B2 * | 9/2013 | Iino | B65H 5/062 271/186 |
| 8,684,354 | B2 | 4/2014 | Iino et al. | |
| 2012/0104677 | A1 | 5/2012 | Iino et al. | |
| 2012/0112406 | A1 * | 5/2012 | Matsumoto | B65H 5/023 271/234 |
| 2018/0282092 | A1 * | 10/2018 | Kamikawa | B65H 9/166 |

* cited by examiner

SHEET CONVEYER AND IMAGE FORMING APPARATUS

CROSS REFERENCE TO RELATED APPLICATION

This application claims priority from Japanese Patent Application No. 2016-242538, filed on Dec. 14, 2016, the entire subject matter of which is incorporated herein by reference.

BACKGROUND

Technical Field

An aspect of the present disclosure is related to a sheet conveyer and an image forming apparatus having the sheet conveyer.

Related Art

An image forming apparatus capable of double-face printing, i.e., printing images on both sides of a sheet, is known. The image forming apparatus may have an inverting conveyer path, or a returning conveyer path, to turn over the sheet for double-face printing. When single-face printing, i.e., printing an image on solely one side of the sheet, is performed, the image forming apparatus may form an image on one side of the sheet and eject the sheet at an ejection tray. When double-face printing is performed, the image forming apparatus may form an image in an image forming unit on one side of the sheet and convey the sheet in the inverting conveyer path. The sheet being conveyed in the inverting conveyer path may be inverted upside-down and conveyed once again to the image forming unit, to form another image on the other side of the sheet. The sheet with the images formed on both sides thereof may be conveyed to exit the image forming unit and ejected at the sheet ejection tray.

In the inverting conveyer path, an oblique conveyer roller, which may convey and shift the sheet sideward to one end of the inverting conveyer path with regard to a widthwise direction (a direction orthogonal to a conveying direction). Meanwhile, a regulative side guide member may be arranged on the one end of the side of the inverting conveyer path. The sheet shifted sideward to the end of the inverting conveyer path may contact the regulative side guide member and may be restricted from moving beyond the regulative side guide member. Thus, the sheet may be conveyed in a correct widthwise position.

SUMMARY

In a sheet conveyer configured as above, however, a force to obliquely convey the sheet sideward may act on the sheet merely when the sheet is in contact with the oblique conveyer roller. Therefore, if a distance to be conveyed by the oblique conveyer roller is too short, in other words, if a length of the sheet along the conveying direction is not enough, the sheet may not be conveyed to the widthwise end completely to reach the side regulative guide member and may fail to be conveyed in the correct widthwise position.

The present disclosure is advantageous in that a sheet conveyer and an image forming apparatus, in which ability for oblique conveyance to shift a sheet sideward to a widthwise end of a conveyer path is improved, are provided.

According to an aspect of the present disclosure, a sheet conveyer to shift a sheet being conveyed in a conveying direction sideward at one side of the sheet conveyer in a widthwise direction, which is orthogonal to the conveying direction, is provided. The sheet conveyer includes a pair of rollers configured to nip the sheet and apply a conveying force to shift the sheet sideward to the sheet, a regulative guide arranged at a position closer to the one side than the pair of rollers in the widthwise direction to extend in the conveying direction and to contact an edge of the sheet closer to the one side in the widthwise direction to regulate a position of the edge, a first guide arranged at a position upstream from the pair of rollers with regard to the conveying direction to contact a first area on a first face of the sheet at a position closer to the one side in the widthwise direction than a widthwise center of the sheet, and a second guide arranged at a position upstream from the pair of rollers with regard to the conveying direction to contact a second area on a second face of the sheet at a position closer to the one side in the widthwise direction than the widthwise center of the sheet, whereas the second area is different from the first area in the widthwise direction. The second guide is arranged to partly overlap the first guide in a direction of height, which is orthogonal to the conveying direction and the widthwise direction.

According to another aspect of the present disclosure, an image forming apparatus including an image forming unit to form an image on a sheet being conveyed and a sheet conveyer to convey the sheet in a conveying direction and shift the sheet being conveyed sideward at one side of the sheet conveyer in a widthwise direction, which is orthogonal to the conveying direction, is provided. The sheet conveyer includes a pair of rollers configured to nip the sheet and apply a conveying force to shift the sheet sideward to the sheet, a regulative guide arranged at a position closer to the one side than the pair of rollers in the widthwise direction to extend in the conveying direction and to contact an edge of the sheet closer to the one side in the widthwise direction to regulate a position of the edge, a first guide arranged at a position upstream from the pair of rollers with regard to the conveying direction to contact a first area on a first face of the sheet at a position closer to the one side in the widthwise direction than a widthwise center of the sheet, and a second guide arranged at a position upstream from the pair of rollers with regard to the conveying direction to contact a second area on a second face of the sheet at a position closer to the one side in the widthwise direction than the widthwise center of the sheet, whereas the second area is different from the first area in the widthwise direction. The second guide is arranged to partly overlap the first guide in a direction of height, which is orthogonal to the conveying direction and the widthwise direction.

BRIEF DESCRIPTION OF THE ACCOMPANYING DRAWINGS

DETAILED DESCRIPTION

Hereinafter, an embodiment of the present disclosure will be described with reference to the accompanying drawings.

[Overall Configuration of Image Forming Apparatus]

Figure 1:
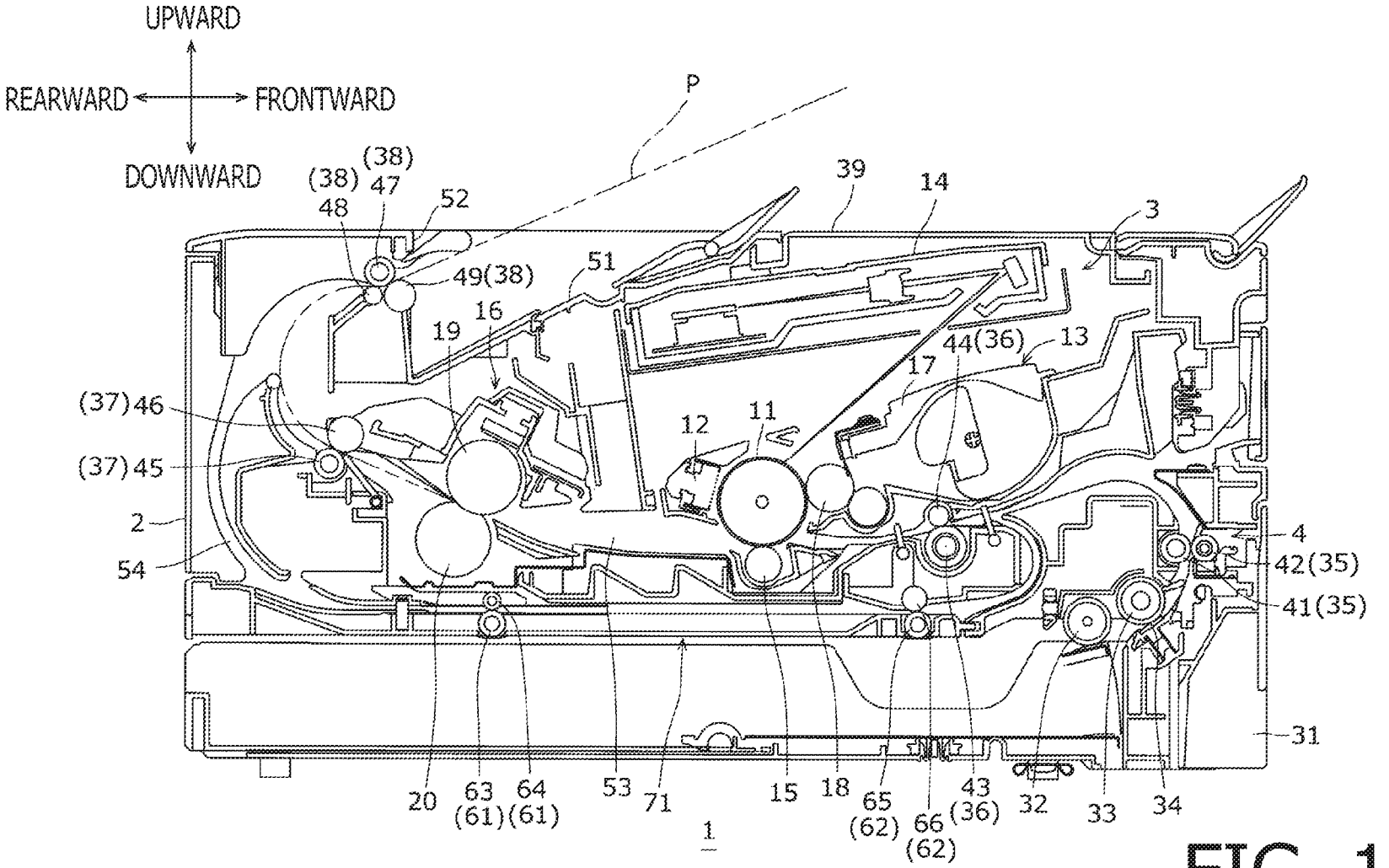
FIG. 1 is an illustrative cross-sectional view of a laser printer with a sheet conveyer according to an embodiment of the present disclosure.

A laser printer 1 according to the present disclosure may be a monochrome laser printer. The laser printer 1 includes, as shown in FIG. 1, a main casing 2. The main casing 2 may be in a form of a rectangular box and accommodates an image forming unit 3 and a conveyer 4.

The image forming unit 3 includes a photosensitive drum 11, a charger 12, a developer device 13, an exposure device 14, a transfer roller 15, and a fuser 16.

The photosensitive drum 11 is rotatable about an axis, which extends along a widthwise direction of the laser printer 1. The widthwise direction may be a direction orthogonal to the cross-section of the laser printer 1 shown in FIG. 1.

The charger 12 is located at an upper position with respect to the photosensitive drum 11, on one side of the axis of the photosensitive drum 11. The charger 12 may be, for example, a scorotron charger with a wire and a grid. In the following description, a frontward side and a rearward side of the laser printer 1 will be divided at a position of the axis of the photosensitive drum 11. In other words, one side from the axis of the photosensitive drum 11, on which the charger 12 is arranged, is defined as a rearward side; and the other side from the axis of the photosensitive drum 11 opposite to the rearward side is defined as a frontward side, as indicated by arrows in FIG. 1. Further, an upper side, a lower side, a leftward side, and a rightward side are defined on basis of a view to a user who stands to face with a frontward face of the laser printer 1. An up-to-down or down-to-up direction to the view may be referred to as a vertical direction, and a front-to-rear or rear-to-front direction may be referred to as a front-rear direction.

The developer device 13 is arranged at a frontward position with respect to the photosensitive drum 11. The developer device 13 includes a housing 17 to hold and accommodate toner and a developer roller 18 therein. The developer roller 18 is rotatable about an axis, which extends along the widthwise direction. The developer roller 18 and the photosensitive drum 11 are in such an arrangement that circumferential surfaces thereof contact each other.

The exposure device 14 is arranged at an upper position with respect to the photosensitive drum 11, the charger 12, and the developer device 13. The exposure device 14 includes an optical system (unsigned), which includes a laser emitter and polygon mirrors, to emit a laser beam based on image data at the circumferential surface of the photosensitive drum 11.

The transfer roller 15 is arranged at a lower position with respect to the photosensitive drum 11. The transfer roller 15 is rotatable about an axis, which extends along the widthwise direction.

The fuser 16 is arranged at a rearward position with respect to the charger 12. The fuser 16 includes a heat roller 19 and a pressure roller 20. The heat roller 19 is rotatable about an axis, which extends along the widthwise direction. The pressure roller 20 is arranged at a lower-rearward position with respect to the heat roller 19 and is rotatable about an axis, which extends long the widthwise direction. The heat roller 19 and the pressure roller 20 are in such an arrangement that circumferential surfaces thereof contact each other.

The conveyer 4 includes a feeder cassette 31, a feeder roller 32, a separator roller 33, a separator pad 34, conveyer rollers 35, 36, 37, an ejector roller 38, and an ejection tray 39.

The feeder cassette 31 is arranged at a bottom area of the main casing 2 and may be drawn frontward from the main casing 2. The feeder cassette 31 may store one or more sheets P there in in a stack.

The feeder roller 32 is arranged at an upper position in an frontend area in the feeder cassette 31. The feeder roller 32 is in such an arrangement that a circumferential surface thereof may contact an upper surface of a topmost sheet P in the stack of sheets P stored in the feeder cassette 31.

The separator roller 33 and the separator pad 34 are arranged at frontward positions with respect to the feeder roller 32. The separator roller 33 is rotatable about an axis, which extends along the widthwise direction. The separator roller 33 is in an arrangement such that a circumferential surface of thereof contacts the separator pad 34 from an upper-rearward side.

The conveyer roller 35 is arranged at an upper-frontward position with respect to the separator roller 33. The conveyer roller 35 includes a pair of rollers, which are a driving roller 41 and a driven roller 42. The driving roller 41 and the driven roller 42 are in an arrangement such that circumferential surfaces thereof contact each other and are rotatable about axes thereof, which extend along the widthwise direction.

The conveyer roller 36 may be a registration roller and is arranged at a frontward position with respect to the photosensitive drum 11 and the transfer roller 15. The conveyer roller 36 includes a pair of rollers, which are a driving roller 43 and a driven roller 44. The driving roller 43 and the driven roller 44 are in such an arrangement that circumferential surfaces thereof contact each other and are rotatable about axes thereof, which extend along the widthwise direction.

The conveyer roller 37 is arranged at an upper-rearward position with respect to the fuser 16. The conveyer roller 37 includes a pair of rollers, which are a driving roller 45 and a driven roller 46. The driving roller 45 and the driven roller 46 in such an arrangement that circumferential surfaces thereof contact each other and are rotatable about axes thereof, which extend along the widthwise direction.

The ejector roller 38 is arranged at an upper position with respect to the conveyer roller 37. The ejector roller 38 includes rollers, which are a driving roller 47 and two (2) driven rollers 48, 49. The ejector roller 38 and the driven rollers 48, 49 are in such an arrangement that circumferential surfaces thereof contact one another and are rotatable about axes thereof, which extend along the widthwise direction.

The ejection tray 39 is formed on an upper face of the main casing 2. A frontward part of the ejection tray 39 may spread approximately orthogonally to the frontward face of the main casing 2 in the front-rear direction and in the widthwise direction. The upper face of the main casing 2 further includes a slope face 51, which inclines lower rearward to form a triangular dent in a cross-sectional view, and a vertical face 52, which extends upward from a rear end of the slope face 51. The slope face 51 forms a rearward part of the ejection tray 39. Meanwhile, the circumferential surface of the ejector roller 38 is partly exposed from the vertical face 52.

In an image forming operation to print images on the sheet P, the image forming unit 3 performs image forming actions, and the conveyer 4 performs sheet conveying actions. The following paragraphs describe the actions to be performed in the image forming unit 3 and the conveyer 4.

In order to convey the sheet P from the feeder cassette 31 to feed to the image forming unit 3, the feeder roller 32 may rotate in a rotating direction, e.g., counterclockwise in the sideward view from the left (see FIG. 1). The rotation of the feeder roller 32 may pick up one of more sheets P, which includes the topmost sheet P in the sheet stack stored in the feeder cassette 31, contacting the circumferential surface of the feeder roller 32, and convey frontward. The sheets P picked up from the feeder cassette 31 may be conveyed through a position between the separator roller 33 and the separator pad 34, and the topmost sheet P may be separated from the other sheets P. The sheet P conveyed through the position between the separator roller 33 and the separator pad 34 may be conveyed in a conveyer path 53, which is formed in an approximate shape of an S in the sideward view, through a position between the paired rollers 41, 42 in the conveyer roller 35; a position between the paired rollers 43, 44 in the conveyer roller 36; a position between the photosensitive drum 11 and the transfer roller 15; a position between the heat roller 19 and the pressure roller 20 in the fuser 16; a position between the paired rollers 45, 46 in the conveyer roller 37; and a position between the roller 47 and the rollers 48, 49 in the ejector roller 38, sequentially.

The photosensitive drum 11 may rotate in a rotating direction, e.g., clockwise in the sideward view from the left. As the photosensitive drum 11 rotates, the circumferential surface of the photosensitive drum 11 may be evenly charged by electrical discharge from the charger 12 and thereafter exposed selectively to the laser beam from the exposure device 14. The laser beam may lower potential in the areas selectively exposed to the laser beam, and an electrostatic latent image may be formed on the circumferential surface of the photosensitive drum 11. Thereafter, positively charged toner may be supplied to the electrostatic latent image on the photosensitive drum 11 by the developer roller 18 in the developer device 13, and the electrostatic image may be developed to be a toner image.

The image forming unit 3 and the conveyer 4 are synchronized to perform the image forming actions and the sheet conveying actions so that the sheet P should be located at the position between the photosensitive drum 11 and the transfer roller 15 when the toner image comes to face the transfer roller 15. Meanwhile, transferring bias may be applied to the surface of the transfer roller 15. The sheet P may be conveyed through the position between the photosensitive drum 11 and the transfer roller 15 so that the toner image carried on the photosensitive drum 11 may be transferred to the surface of the sheet P due to the effect of the transferring bias. The sheet P with the transferred image may be conveyed to the fuser 16, in which the sheet P travels through the position between the heat roller 19 and the pressure roller 20. Thus, the toner image on the sheet P may be fixed thereon by the heat and the pressure from the heat roller 19 and the pressure roller 20, and the image forming on the sheet P may be completed.

The laser printer 1 may conduct single-face printing, in which an image may be formed on solely one side (a first face) of the sheet P, and double-face printing, in which images may be formed on both sides (a first face and a second face) of the sheet P.

In single-face printing, after an image is formed on the first face of the sheet P, the sheet P may be conveyed to be ejected by the conveyer roller 37 and the ejector roller 38 at the ejection tray 39.

For double-face printing, formed in the main casing 2 is an inverting conveyer path 54. The inverting conveyer path 54 may begin at a position between the conveyer roller 37 and the ejector roller 38 to curve rearward and downward at a rearward end area in the main casing 2, extends frontward in an area between the image forming unit 3 and the feeder cassette 31, and is connected to the conveyer path 53 at a position between the conveyer roller 35 and the conveyer roller 36. On the inverting conveyer path 54, arranged are a first inverting conveyer roller 61 and a second inverting conveyer roller 62.

The first inverting conveyer roller 61 includes a pair of rollers, which are a driving roller 63 and a driven roller 64. The driving roller 63 and the driven roller 64 are in such an arrangement that circumferential surfaces thereof contact each other and are rotatable about axes thereof, which extend along the widthwise direction.

The second inverting conveyer roller 62 is arranged at a frontward position with respect to the first inverting conveyer roller 61. The second inverting conveyer roller 62 includes a pair of rollers, which are a driving roller 65 and a driven roller 66. The driving roller 65 and the driven roller 66 are in such an arrangement that circumferential surfaces thereof contact each other and are rotatable about axes thereof, which extend along the widthwise direction.

In double-face printing, an image may be formed on a first face of the sheet P, and the sheet P may be directed by the ejector roller 38, without being ejected, to the inverting conveyer path 54. The sheet P may be conveyed frontward in the inverting conveyer path 54 by the first inverting conveyer roller 61 and the second inverting conveyer roller 62 to the conveyer path 53. The sheet P may be inverted upside-down by being conveyed through the inverting conveyer path 54 and conveyed in the conveyer path 53 with a second face, on which no image may be formed yet, facing toward the photosensitive drum 11. Thereafter, another image may be formed on the second face of the sheet P, and the double-face printing with the sheet P may be completed. The sheet P with the images formed on both sides thereof may be conveyed to be ejected by the conveyer roller 37 and the ejector roller 38 at the ejection tray 39.

[Inverting Conveyer Unit]

The laser printer 1 includes an inverting conveyer unit 71. The inverting conveyer unit 71 forms a part of the inverting conveyer path 54 that extends in the front-rear direction, i.e., the area extending between the image forming unit 3 and the feeder cassette 31.

Figure 2:
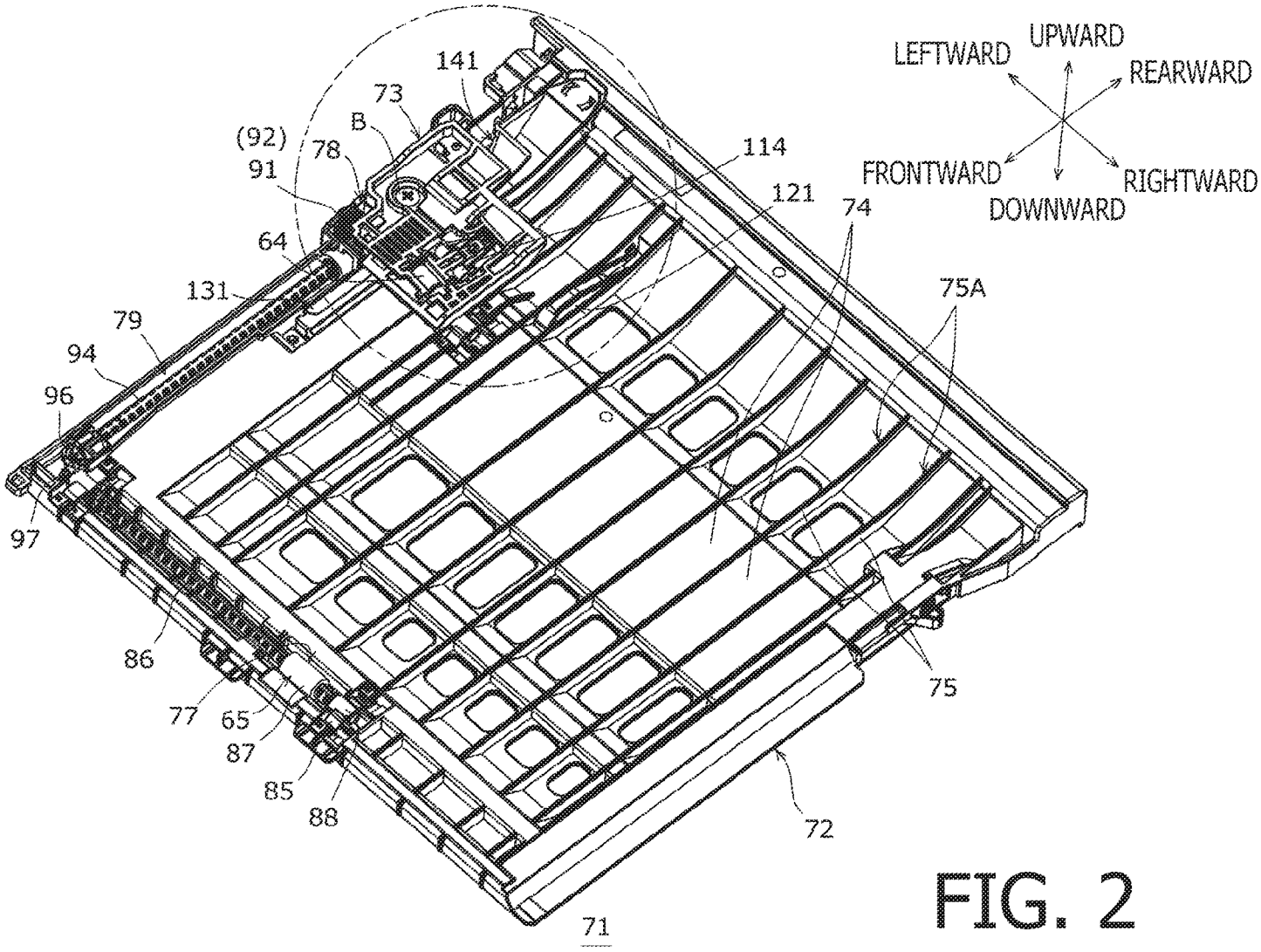
FIG. 2 is a perspective view of an inverting conveyer unit in the laser printer according to the embodiment of the present disclosure.
Figure 3:
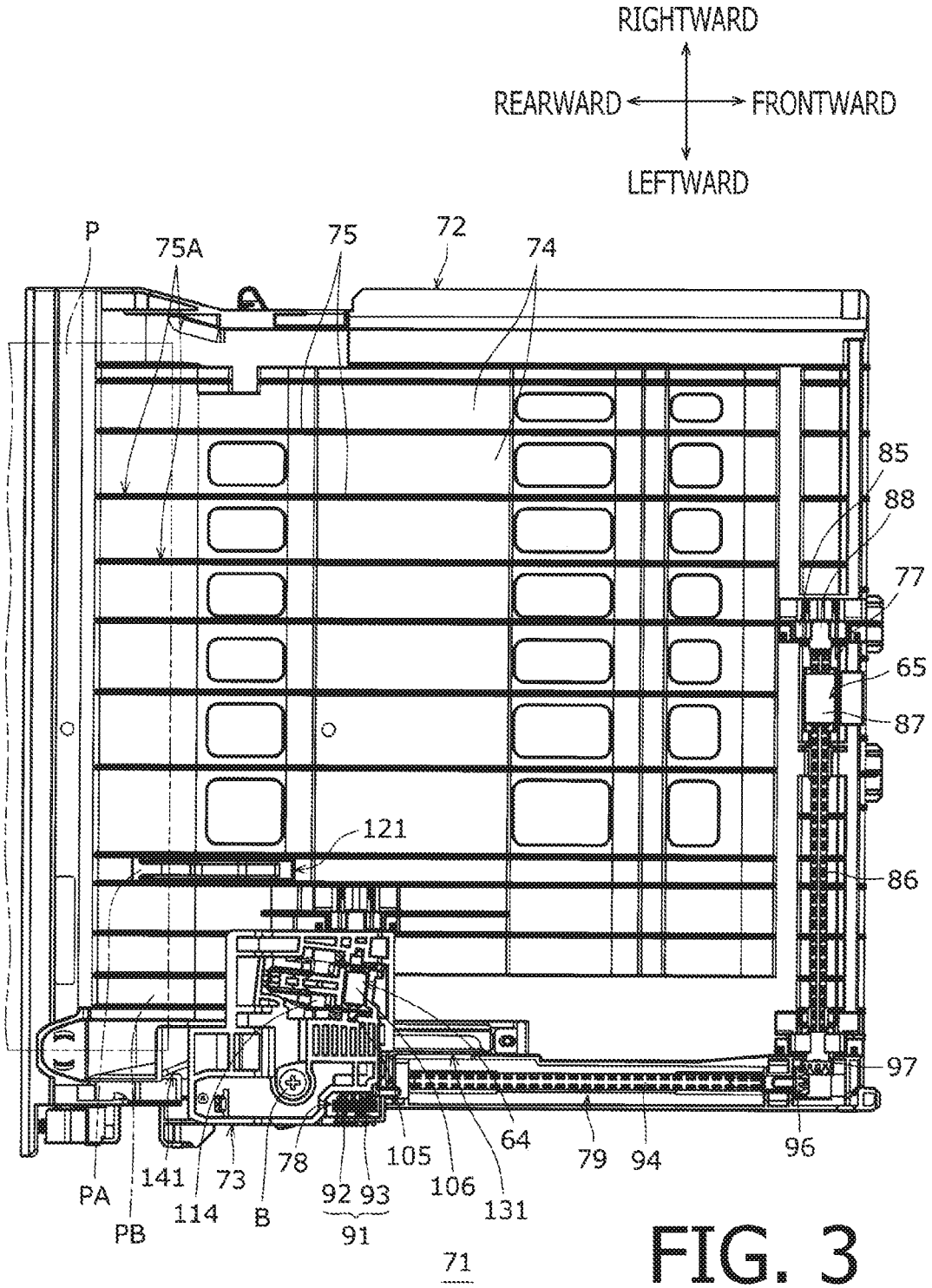
FIG. 3 is a plan view of the inverting conveyer unit in the sheet conveyer according to the embodiment of the present disclosure.

The inverting conveyer unit 71 includes, as shown in FIGS. 2 and 3, a unit body 72 and a holder 73 attached to a rear-leftward area in the unit body 72. The unit body 72 and the holder 73 may be made of a resin.

[Unit Body]

Figure 4:
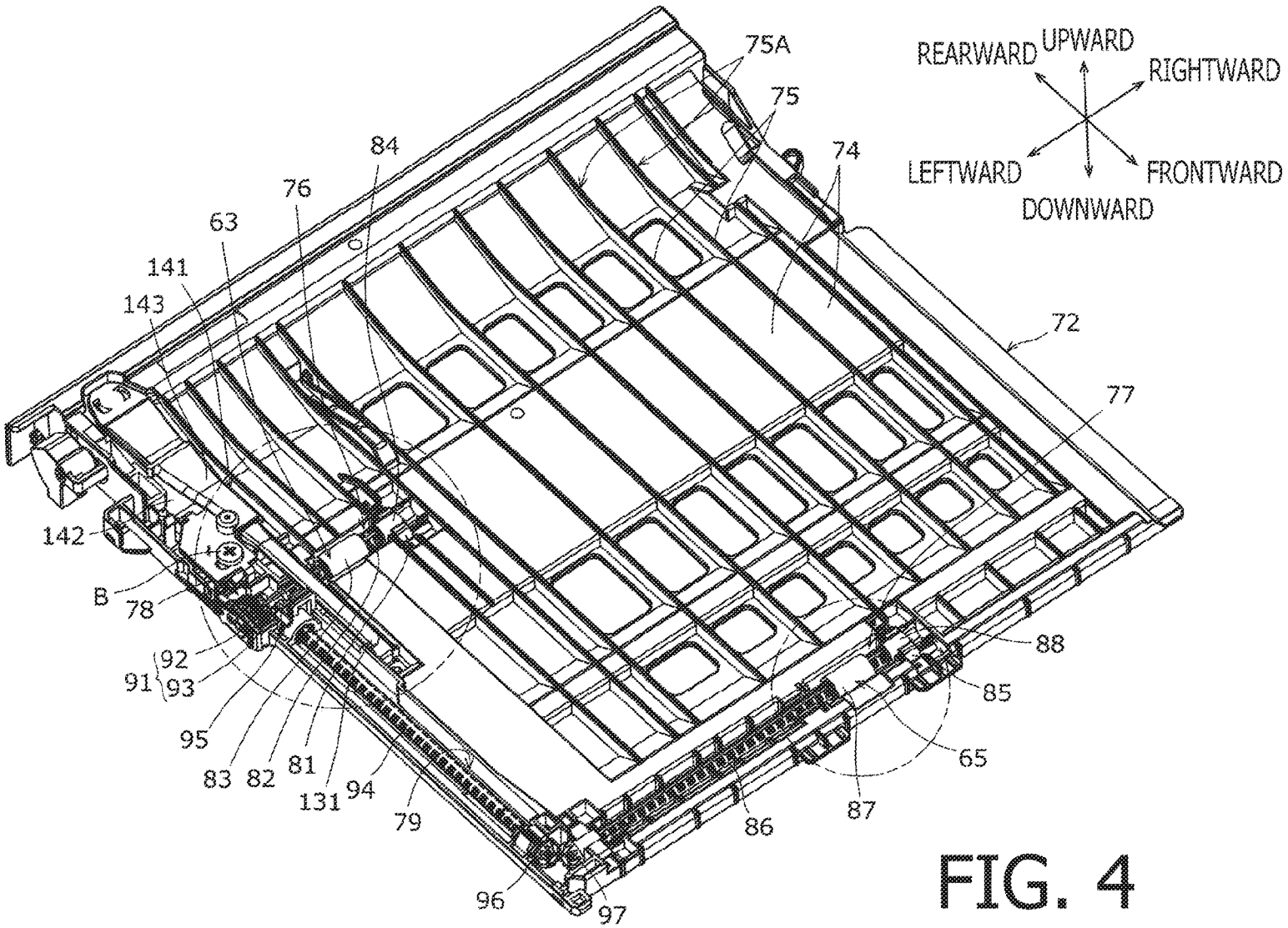
FIG. 4 is a perspective view of a unit body of the inverting conveyer unit according to the embodiment of the present disclosure.

The unit body 72 includes, as shown in FIGS. 2-4, a bottom plate 74 and a plurality of ribs 75.

The bottom plate 74 is a plate spreading in the front-rear direction and the widthwise direction. A rearward end portion of the bottom plate 74 is rounded in an arc curved upper-rearward.

The ribs 75 protrude from an upper face of the bottom plate 74 upward orthogonally to the upper face of the bottom plate 74. The ribs 75 are spaced apart from one another along the widthwise direction and longitudinally extend in the front-rear direction, which coincides with a conveying direction to convey the sheet P at a part of the inverting conveyer path 54. Upper edges of the ribs 75, except at least rearward end portions 75A formed on the rearward end portion of the bottom plate 74, align at a same height to be contained in a plane to support the sheet P being conveyed in the inverting conveyer path 54 from below. Meanwhile, the rearward end portions 75A of the ribs 75 are curved along the rearward end portion of the bottom plate 74 to be higher toward the rear. The rearward end portions 75A of the ribs 75 may contact the sheet P from below and change a direction of a course to convey the sheet P within a direction orthogonal to the widthwise direction, e.g., the vertical direction, into the conveying direction, e.g., the front-rear direction.

Meanwhile, the unit body 72 includes a first roller housing 76, a second roller housing 77, an input gear housing 78, and a driving shaft housing 79, which are dented downward from the plane containing the upper edges of the ribs 75.

Figure 5:
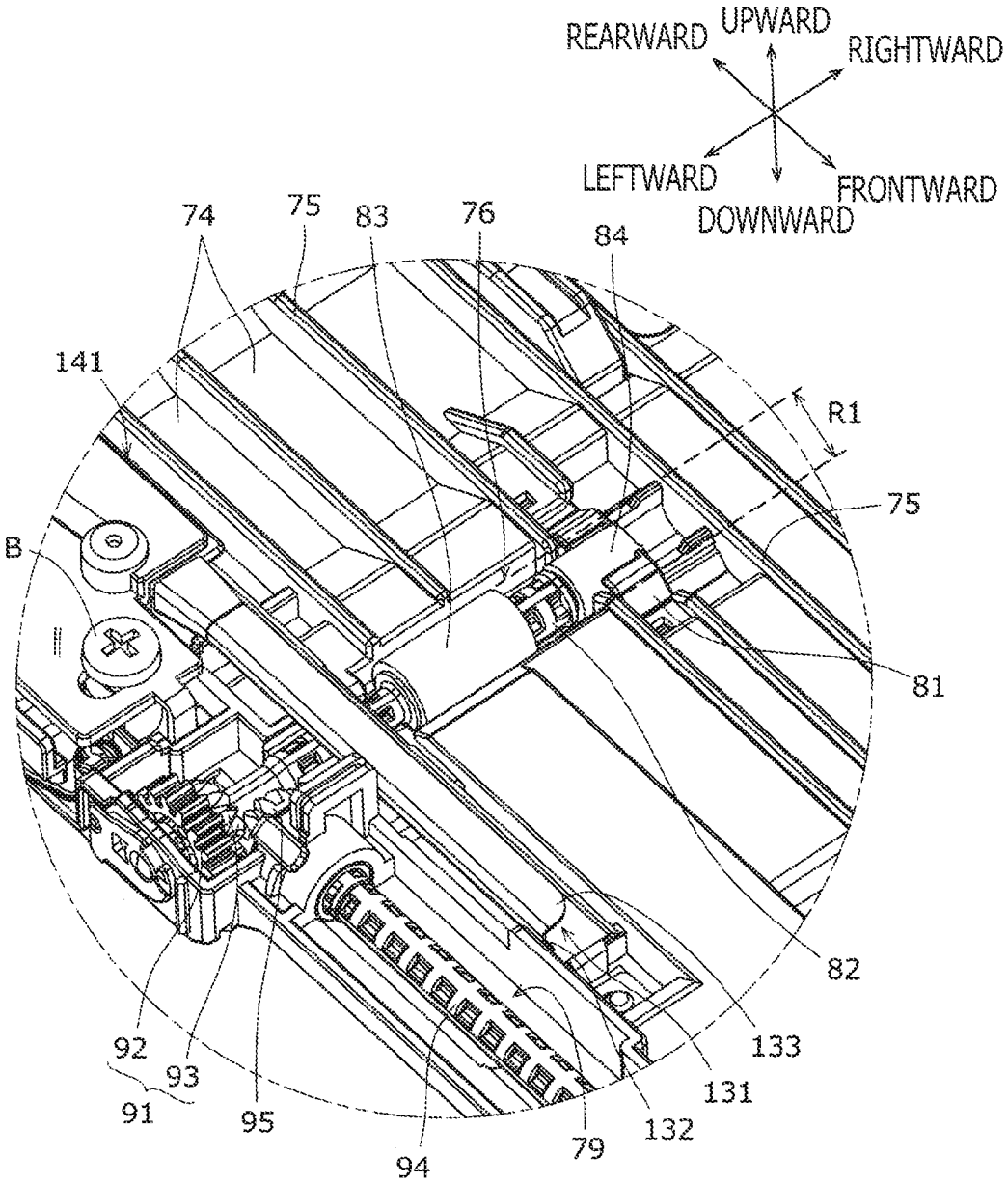
FIG. 5 is an enlarged perspective view of an area in the unit body of the inverting conveyer unit, including a second inverting conveyer roller, encircled in a dash-and-dots line in FIG. 4, according to the embodiment of the present disclosure.

The first roller housing 76 is formed in a midst area with regard to the front-rear direction in the unit body 72 at a leftward position with regard to the widthwise direction. At a rightward end of the first roller housing 76, as shown in FIG. 5, formed is a bearing 81, which has an approximate shape of an upward-open U. In the first roller housing 76, arranged is the driving roller 63 of the first inverting conveyer roller 61. The driving roller 63 includes a shaft 82 made of a resin and a tubular rubber piece 83 attached on an outer periphery of the shaft 82. On one end, e.g., a rightward end, of the shaft 82, fixed to the outer periphery of the shaft 82 is a collar 84. With the collar 84 being supported by the bearing 81 from below, and the shaft 82 extending in the widthwise direction, the driving roller 63 is rotatable about the shaft 82. Meanwhile, a circumferential surface of the rubber piece 83 partly protrudes upward from the plane containing the upper edges of the ribs 75. Therefore, the sheet P being conveyed in the inverting conveyer path 54 may contact the circumferential surface of the rubber piece 83.

Figure 6:
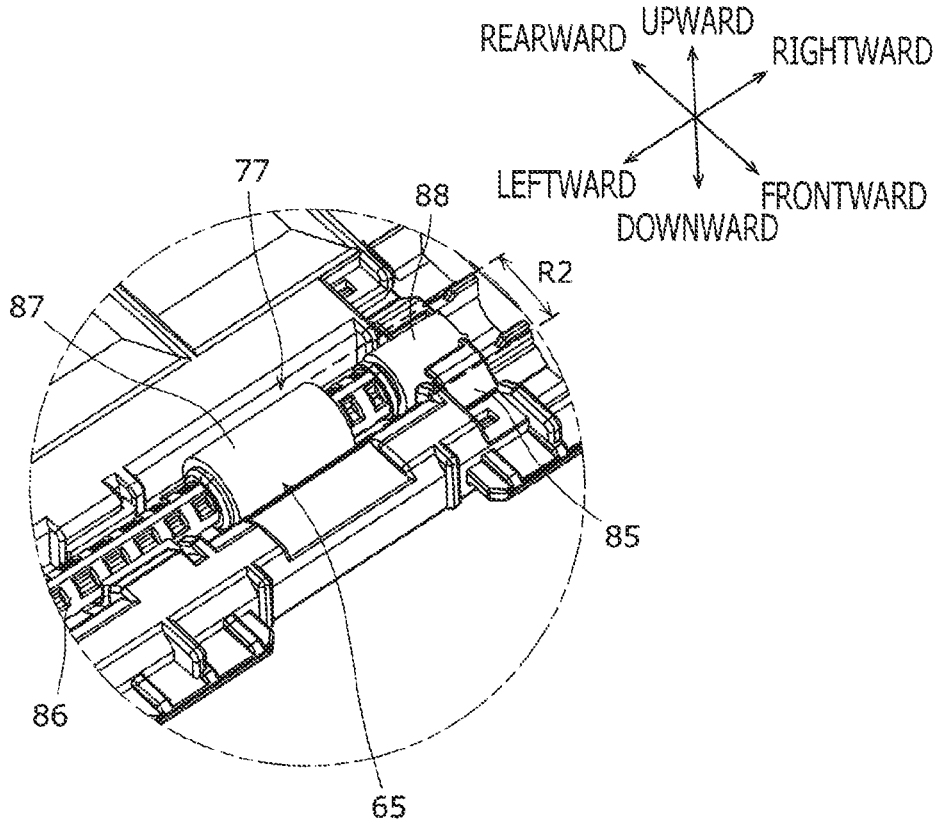
FIG. 6 is an enlarged perspective view of an area in the unit body of the inverting conveyer unit, including a first inverting conveyer roller, encircled in a dash-and-dots line in FIG. 4, according to the embodiment of the present disclosure.

The second roller housing 77 is formed at a frontward end area in the unit body 72 in a range between a widthwise midst area and a leftward end of the unit body 72. At a rightward end of the second roller housing 77, as shown in FIG. 6, formed is a bearing 85, which has an approximate shape of an upward-open U. In the second roller housing 77, arranged is the driving roller 65 of the second inverting conveyer roller 62. The driving roller 65 includes a shaft 86 made of a resin and a tubular rubber piece 87 attached on an outer periphery of the shaft 86. On one end, e.g., a rightward end, of the shaft 86, fixed to the outer periphery of the shaft 86 is a collar 88. With the collar 88 being supported by the bearing 85 from below, the shaft 86 extending in the widthwise direction, and the rubber piece 87 being arranged at the widthwise central area within the unit body 72, the driving roller 65 is rotatable about the shaft 86. Meanwhile, a circumferential surface of the rubber piece 87 partly protrudes upward from the plane containing the upper edges of the ribs 75. Therefore, the sheet P being conveyed in the inverting conveyer path 54 may contact the circumferential surface of the rubber piece 87. An outer diameter R2 of the rubber piece 87 is larger than an outer diameter R1 (see FIG. 5) of the rubber piece 83 in the driving roller 63 (i.e., R2>R1).

The input gear housing 78 is formed at a leftward end area in the unit body 72 at a leftward position with respect to the first roller housing 76. In the input gear housing 78, as shown in FIG. 5, arranged is an input gear 91 made of resin 91. The input gear 91 is formed to have a spur gear 92 and a bevel gear 93 integrally. The bevel gear 93 is arranged at a rightward position with respect to the spur gear 92 and has an approximate shape of a truncated cone, which is tapered to be smaller toward the right. The input gear housing 78 is continuous with the first roller housing 76. The shaft 82 of the driving roller 63 extends along the widthwise direction through the first roller housing 76 to reach the input gear housing 78, and a leftward end of the shaft 82 is coupled with the input gear 91, more specifically, with the bevel gear 93.

The driving shaft housing 79 is formed at a leftward end area in the unit body 79 at a frontward position from the input gear housing 78. The driving shaft housing 79 is continuous with the input gear housing 78 and the second roller housing 77. In the driving shaft housing 79, arranged is a transmission shaft 94 made of resin. The transmission shaft 94 extends in the front-rear direction through the driving shaft housing 79 to reach the input gear housing 78. A rearward end and a frontward end of the transmission shaft 94 are, as shown in FIG. 4, coupled with a bevel gear 95 and a bevel gear 96, respectively. The bevel gear 95 meshes with the bevel gear 93 in the input gear 91. Meanwhile, the shaft 86 of the driving roller 65 extends in the widthwise direction through the second roller housing 77 to reach the driving shaft housing 79. A leftward end of the shaft 86 is coupled with the bevel gear 97. The bevel gear 96 meshes with the bevel gear 97, which is coupled with the shaft 86.

When a driving force from a motor (not shown) is input to the input gear 91, the driving roller 63 in the first inverting conveyer roller 61 rotates integrally with the input gear 91. Further, the driving force input to the input gear 91 is transmitted to the driving roller 65 in the second inverting conveyer roller 62 through the transmission shaft 94, and the driving roller 65 rotates.

[Holder]

Figure 7:
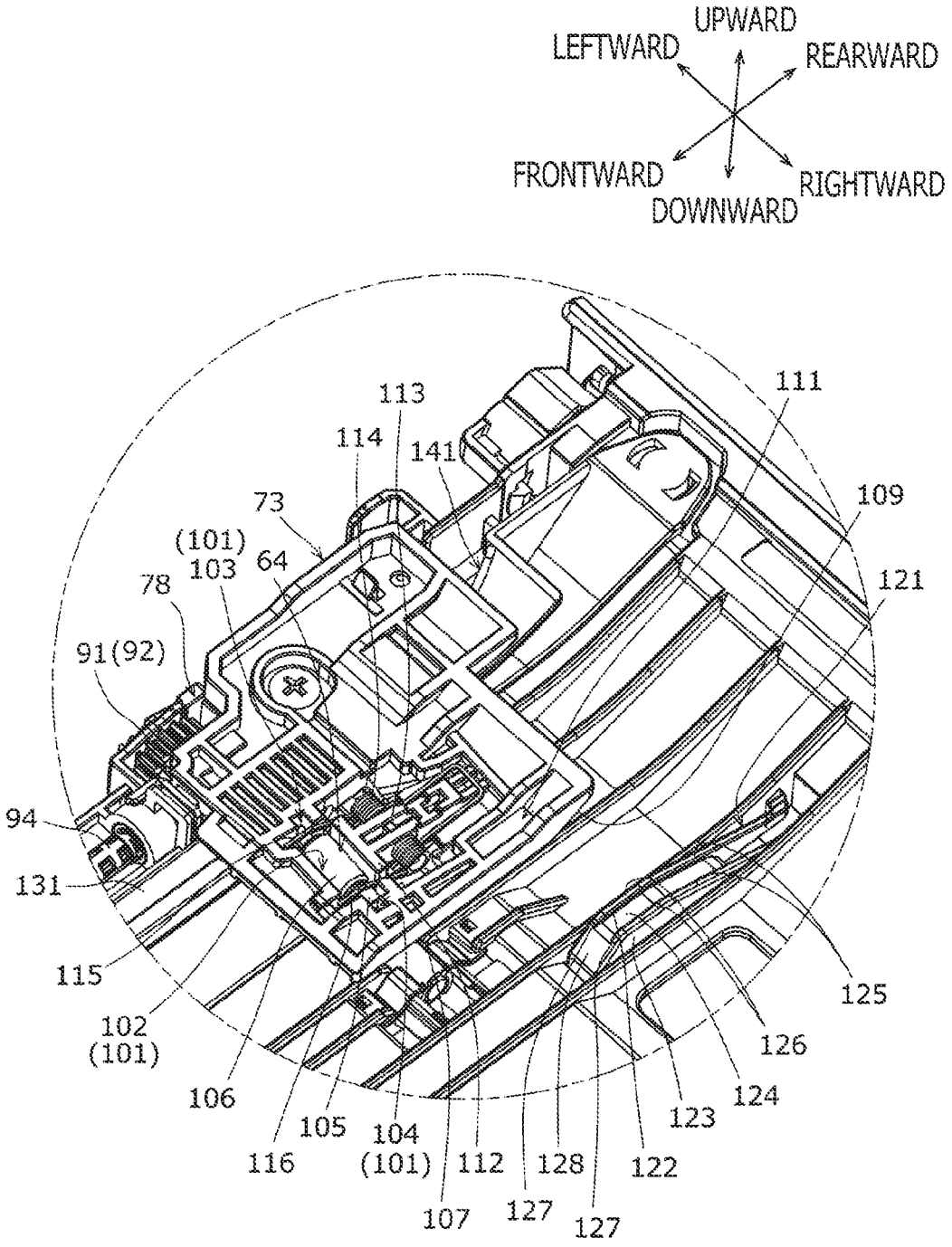
FIG. 7 is an enlarged perspective view of an area in the inverting conveyer unit, including a holder, encircled in a dash-and-dots line in FIG. 2, according to the embodiment of the present disclosure.

The holder 73 has, as shown in FIG. 7, an approximate shape of a square plate, but lacking a front-leftward portion and a rear-rightward portion. The holder 73 may be attached to the unit body 72 through a bolt B.

In a front-rightward area in the holder 73, formed is a driven roller housing 101. At a widthwise midst area in the driven roller housing 101, formed through along the vertical direction is an opening 102. At a leftward end and a rightward end of the driven roller housing 101, formed are dented sections 103, 104, respectively, which are dented downward to be lower than an upper face of the holder 73. The dented sections 103, 104 are displaced from each other with regard to the widthwise direction.

Figure 8:
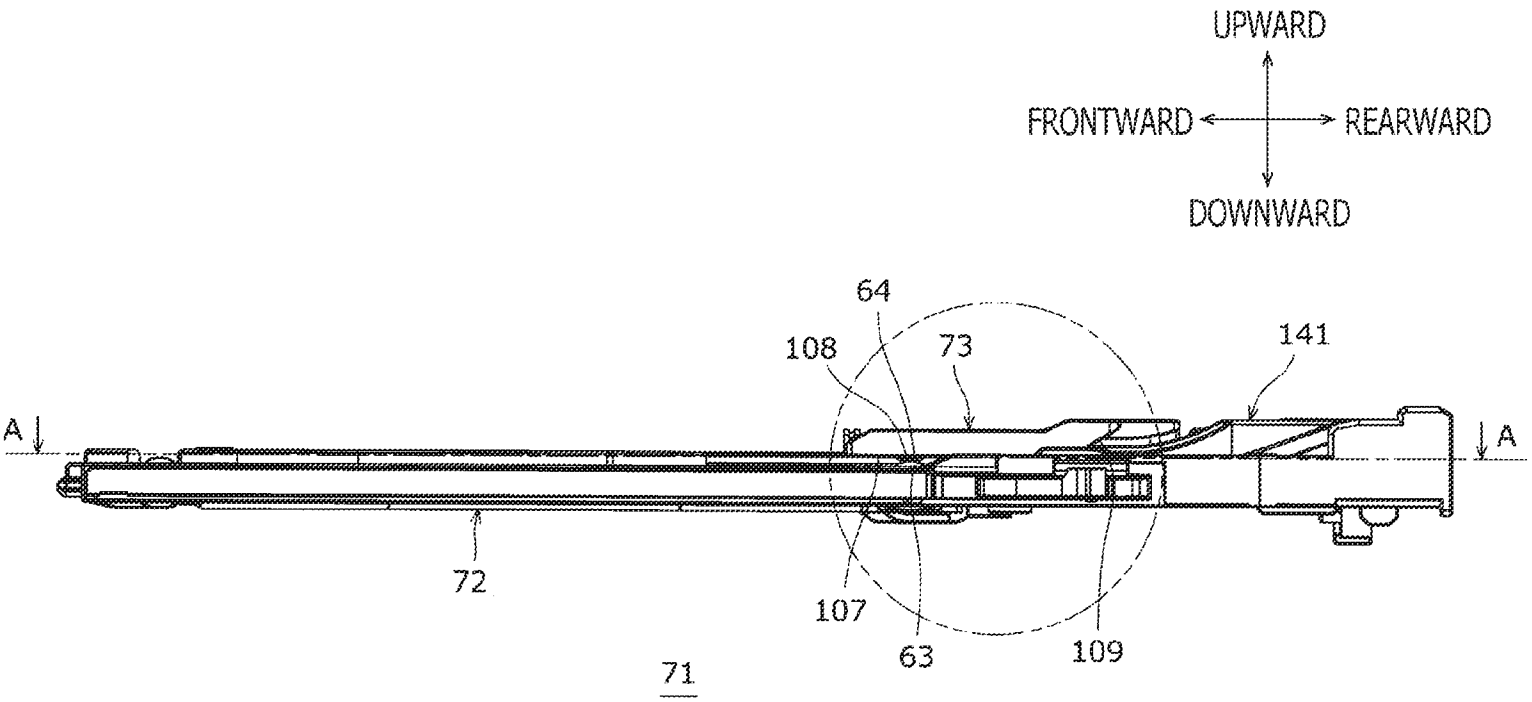
FIG. 8 is a sideward view of the inverting conveyer unit in the sheet conveyer according to the embodiment of the present disclosure.
Figure 9:
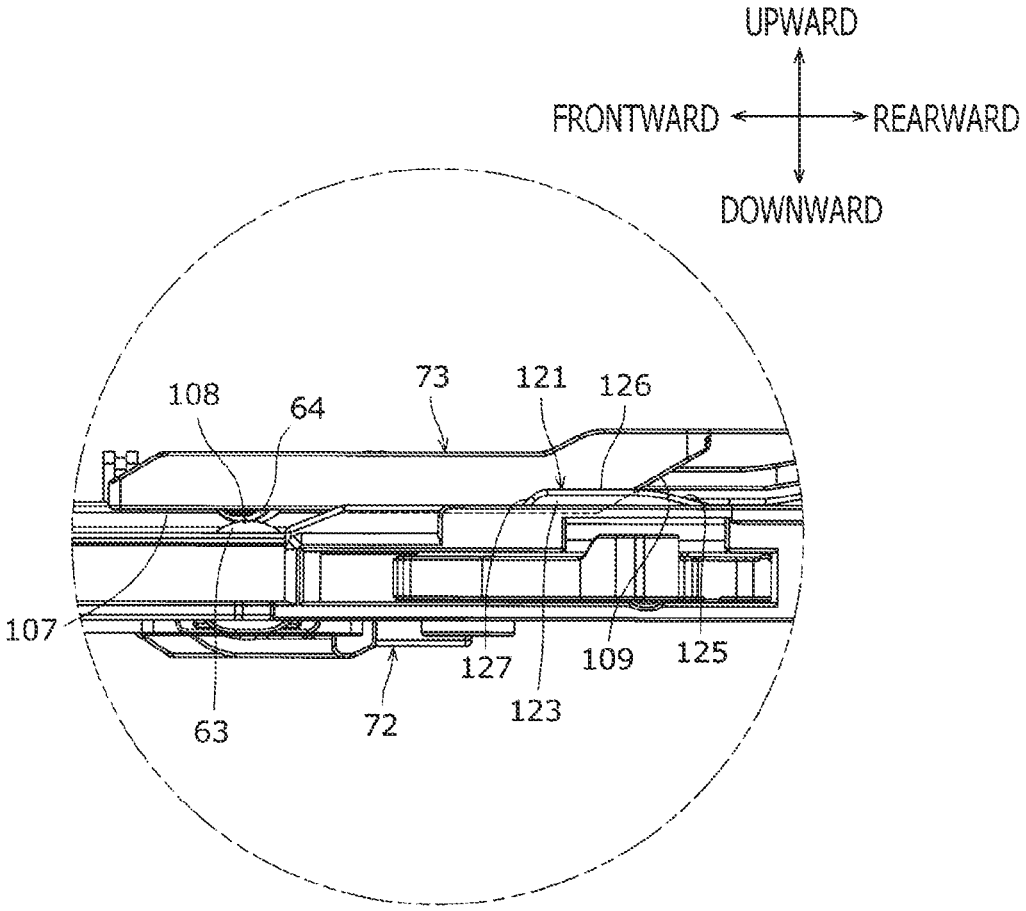
FIG. 9 is an enlarged sideward view of an area in the inverting conveyer unit, including the holder, encircled in a dash-and-dots line in FIG. 8, according to the embodiment of the present disclosure.

In the driven roller housing 101, arranged is the driven roller 64 in the first inverting conveyer roller 61. The driven roller 64 includes a shaft 105 made of resin and a tubular rubber piece 106 attached on an outer periphery of the shaft 105. Axial ends of the shaft 105 protrude outward from ends of the rubber piece 106. With the axial ends of the shaft 105 being supported by the dented sections 103, 104, the shaft 105 is arranged to extend in an oblique orientation with respect to the widthwise direction with the rightward end thereof being closer to the front and the leftward end thereof being farther from the front, and the driven roller 64 is rotatable about the shaft 105. Meanwhile, as shown in FIGS. 8-9, a circumferential surface of the rubber piece 106 partly protrudes downward from a downward face 107 of the holder 7 to contact the rubber piece 83 in the driving roller 63 from above. In this regard, the downward face 107 of the holder 73 is located at an upper position with respect to a nipping point 108, which is between the rubber piece 83 in the driving roller 63 and the rubber piece 106 in the driven roller 64. In other words, the downward face 107 of the holder 73 is on a same side with respect to the nipping point 108 as the driven roller 64 rather than on a same side as the driving roller 63.

Meanwhile, an inclined face 109 at a rear-rightward end section in the downward face 107 of the holder 73 inclines to be lower at the front and higher at the rear.

As shown in FIG. 7, the holder 73 includes a spring housing 111 at a rearward position with respect to the driven roller housing 101. At a position between the driven roller housing 101 and the spring housing 111, formed is a partition wall 112. Meanwhile, in the spring housing 111, formed is a spring retainer 113 integrally with the partition wall 112. The spring retainer 113 extends rearward from a widthwise midst area in the partition wall 112.

In the spring housing 111, arranged is a torsion coil spring 114, which is a piece of wire coiled and bended. The torsion coil spring 114 is retained by the spring retainer 113 while ends 115, 116 of the torsion coil spring 114 contact axial ends of the shaft 105 of the driven roller 64 from above. Therefore, the driven roller 64 may be urged by resiliency of the torsion coil spring 114 against the dented sections 103, 104 in the driven roller housing 101.

[Resistance Applier]

A resistance applier 121 is arranged on the unit body 72 at a rear-rightward position with respect to the holder 73 and a leftward position with respect to a widthwise center of the bottom plate 74. The resistance applier 121 protrudes upward from the bottom plate 74 at a position between two ribs 75. The resistance applier 121 includes a leftward section 122, a rightward section 123, which are spaced apart to face each other along the widthwise direction, and an intermediate section 124, which intervenes between the leftward section 122 and the rightward section 123, integrally.

The leftward section 122 and the rightward section 123 are each in a shape of a plate spreading in the vertical direction and in the front-rear direction. Each upper face of the leftward section 122 and the rightward section 123 includes a rearward inclined face 125, a parallel face 126, and a frontward inclined face 127. The rearward inclined face 125 inclines to be higher toward the front and lower toward the rear. The parallel face 126 extends frontward from a frontward end of the rearward inclined face 125 in parallel with the upper face of the bottom plate 74. The frontward inclined face 127 extends from a frontward end of the parallel face 126 and inclines to be higher toward the rear and lower toward the front. The frontward inclined faces 127 align on a same plane with a frontward face 128 of the intermediate section 124.

The frontward end of the rearward inclined face 125, or a rearward end of the parallel face 126, is located rearward with respect to a frontward end of the inclined face 109 of the holder 73, and approximately a rearward half of the rearward inclined face 125 overlaps the rearward end portions 75A of the ribs 75 across the widthwise direction. A frontward end of the parallel face 126 is located frontward with respect to a frontward end of the inclined face 109. Meanwhile, the parallel face 126 is located to be higher than upper edges of the ribs 75 and higher than the downward face 107, including the frontward end of the inclined face 109, of the holder 73. In this regard, the holder 73 and the resistance applier 121 overlap each other in a direction of height of the resistance applier 121, i.e., the vertical direction.

[Guides]

The unit body 72 further includes, as shown in FIGS. 4 and 5, a regulative guide 131. The regulative guide 131 is arranged at a leftward position with respect to the rubber piece 83 of the driving roller 63 and a rightward position with respect to the input gear housing 78 to extend in the front-rear direction crossing over the first roller housing 76. A frontward end of the regulative guide 131 is located at a position downstream, e.g., a frontward position, from the first inverting conveyer roller 61 with regard to the conveying direction. The regulative guide 131 includes, as shown in FIG. 5, a regulative wall section 132 and an extended section 133 integrally. The regulative wall section 132 is in a form of a plate spreading upward with respect to the bottom plate 74 and in the front-rear direction. The extended section 133 extends rightward from an upper end of the regulative wall section 132.

Figure 10:
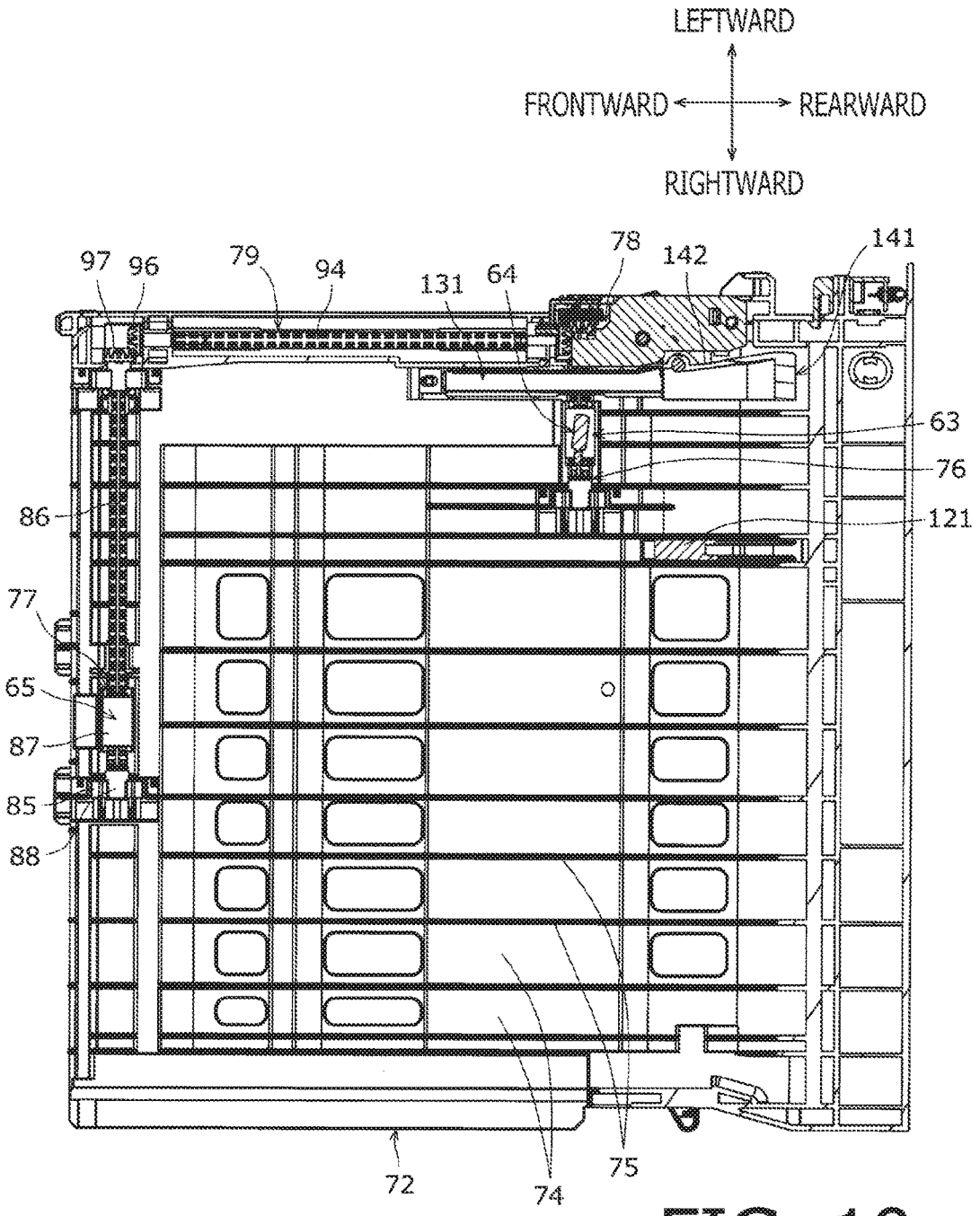
FIG. 10 is a cross-sectional view of the inverting conveyer unit according to the embodiment of the present disclosure taken at a line A-A shown in FIG. 8.

The unit body 72 further includes, as shown in FIG. 10, a directive guide 141. The directive guide 141 is arranged at a rearward position with respect to the regulative guide 131 and a rear-rightward position with respect to the driving roller 63 to extend in the front-rear direction. A frontward end of the directive guide 141 is connected with a rearward end of the regulative guide 31. The directive guide 141 includes, as shown in FIG. 4, a directive wall section 142 and an extended section 143 integrally. The directive wall section 142 is, as shown in FIG. 10, in a form of a plate spreading upward with respect to the bottom plate 74 and in an oblique direction with respect to the front-rear direction to be closer to the left at the front and farther from the left at the rear. The extended section 143 extends, as shown in FIG. 4, rightward from an upper end of the directive wall section 142.

[Sheet Conveying Actions]

In double-face printing, the sheet P with an image formed on a first face may be conveyed in the inverting conveyer path 54 by a conveying force of the ejector roller 38 (see FIG. 1). As the sheet P enters the inverting conveyer path 54, a leading portion including a leading edge of the sheet P may travel through the curve in the inverting conveyer path 54 formed in the rearward area with respect to the conveyer roller 37 and reach the inverting conveyer unit 71, as shown in FIG. 3. Meanwhile, the ejector roller 38 may keep nipping a trailing portion of the sheet P between the driving roller 47 and the driven rollers 48, 49.

The leading portion of the sheet P reaching the inverting conveyer unit 71 may slide on the rearward end portions 75A of the ribs 75. Meanwhile, with the trailing portion of the sheet P being nipped by the ejector roller 38, an intermediate portion between the leading portion and the trailing portion may bow rearward, and the leading end of the sheet P may contact the rearward inclined face 125 in the resistance applier 121 at an area PA, which is closer to the left than a widthwise center of the leading part of the sheet P. The area PA contacting the rearward inclined face 125 may climb on the rearward inclined face 125.

When, for example, the sheet P reaching the inverting conveyer unit 71 is at a position deviated leftward from a correct position, a leftward edge of the sheet P may contact and slide on the directive wall section 142 (see FIG. 10) in the directive guide 141 as the leading portion of the sheet P climbs on the rearward inclined face 125. Thus, the sheet P may be shifted rightward.

As the sheet P is conveyed further in the inverting conveyer unit 71, the area PA of the sheet P in the leading portion may travel on the parallel plane 126 in the resistance applier 121, and another area PB of the sheet P in the leading portion, which is closer to the left than the area PA contacting the parallel plane 126, may contact the inclined face 109 in the holder 73. As the sheet P travels further, the area PB is shifted by the inclined face 109 to descend underneath the downward face 107. Thus, while the area PA of the sheet P in the leading portion, which is on the leftward side of the sheet P with regard to the widthwise center, may be on top of the resistance applier 121, another area PB on the further left from the area PA may descend underneath the downward face 107 of the holder 73. Therefore, a leftward part of the sheet P with respect to the widthwise center may be subject to a greater intensity of conveying resistance than a rightward part of the sheet P with respect to the widthwise center. Accordingly, the rightward part of the sheet P in the leading portion may travel faster, and the leftward part of the sheet P in the leading portion may travel slower. In this regard, while the trailing portion in the sheet P may be maintained nipped by the ejector roller 38, the intermediate portion may be maintained bowed rearward. Therefore, the leading portion of the sheet P is allowed to swing in the widthwise direction. Thus, the leading portion of the sheet P may be twisted with respect to the trailing portion to be shifted leftward.

When the leading portion of the sheet P enters the position between the driving roller 63 and the driven roller 64 in the first inverting conveyer roller 61, a conveying force from the first inverting conveyer roller 61 may be applied to the sheet P. Meanwhile, the shaft 105 of the driven roller 64 inclines with respect to the widthwise direction; therefore, the conveying force from the driven roller 64 applied to the sheet P may incline to be an oblique conveying force, which acts in an oblique direction to be closer to the left at the front and farther from the left at the rear.

When the leading portion of the sheet P enters the position between the driving roller 65 and the driven roller 65 in the second inverting conveyer roller 62 (see FIG. 1), the intermediate portion of the sheet P may be subject to the conveying force from the first inverting conveyer roller 61 while the leading portion of the sheet P may be subject to the conveying force from the second inverting conveyer roller 62. In this regard, the outer diameter R2 of the driving roller 65 in the second inverting conveyer roller 62 is greater than the outer diameter R1 of the driving roller 63 in the first inverting conveyer roller 61. Therefore, while rotating velocities of the driving rollers 63, 65 may be the same, a circumferential velocity, i.e., a moving velocity on the circumferential surface, of the driving roller 65 is greater than a circumferential velocity of the driving roller 63. With this difference between the circumferential velocities, intensities of the resistance to be applied to the sheet P by the first inverting conveyer roller 61 and the second inverting conveyer roller 62 become different. Therefore, the oblique conveying force to shift the sheet P leftward may be increased.

Accordingly, the sheet P may be shifted leftward promptly while being conveyed frontward on the inverting conveyer unit 71. When the leftward edge of the sheet P contacts the regulative wall section 132 in the regulative guide 131, the sheet P may be restricted from moving further leftward, and the sheet P may be placed at a correct widthwise position.

[Benefits]

The sheet P nipped by the first inverting conveyer roller 61 may be subject to the oblique conveying force to shift the sheet P leftward from the first inverting conveyer roller 61. At the position upstream from the first inverting conveyer roller 61 along the conveying direction, located are the rear-rightward edge of the holder 73 and the resistance applier 121. Therefore, the sheet P may contact the holder 73 and the resistance applier 121 prior to entering the first inverting roller 61, and the conveying resistance may be applied to the sheet P effectively.

Meanwhile, the holder 73 and the resistance applier 121 are arranged to contact the leftward part of the sheet P with respect to the widthwise center. Therefore, difference in the intensities of the resistance occurs between the leftward part and the rightward part of the sheet P, and the rightward part may be conveyed faster to precede the leftward part. Accordingly, the oblique conveying force to shift the sheet P sideward against the regulative guide 131, which is arranged leftward from the first inverting conveyer roller 61, is produced. Thus, ability to shift the sheet P leftward may be improved, and the sheet P may be moved sideward completely to the left to reach the regulative guide 131.

The unit body 72 may include the bottom plate 74 and the plurality of ribs 75 extending upward from the upper face of the bottom plate 74. The rearward end portions 75A of the ribs 75 are located at the position upstream, i.e., rearward, from the holder 73 and the resistance applier 121 with regard to the conveying direction, to contact the sheet P and direct the sheet P in a different conveying direction with respect to the direction orthogonal to the widthwise direction along the curve. Therefore, when the holder 73 and the resistance applier 121 apply the conveying resistance to the leading portion of the sheet P, the sheet P may curve along the rearward end portions 75A of the ribs 75.

If, for example, the holder 73 and the resistance applier 121 apply the conveying resistance to the leading portion of the sheet P while the sheet P is straightened flatly, the leading portion may be twisted less easily with respect to the trailing portion due to resiliency of the sheet P. Therefore, the effect to obliquely convey the sheet P by the conveying resistance may be lessened. Meanwhile, if the conveying resistance from the holder 73 and the resistance applier 121 is applied to the leading portion of the sheet P while the sheet P is curved, the leading portion may be twisted with respect to the trailing portion more easily, and the effect to obliquely convey the sheet P by the conveying resistance may be substantially achieved. Thus, the ability to shift the sheet P leftward may be improved.

The holder 73 and the resistance applier 121 are arranged at the positions displaced from the first inverting conveyer roller 61 with regard to the widthwise direction. Therefore, the conveying resistance from the first inverting conveyer roller 61 and the conveying resistance from the holder 73 and the resistance applier 121 may be prevented from concentrating on a same spot in the sheet P. Accordingly, the intensity of the conveying resistance to be applied to the leftward side of the sheet P may be prevented from being excessively increased, and conveyance error in the sheet P due to the excessive intensity of conveying resistance may be prevented.

The holder 73 has the inclined face 109 at the rearward end being the upstream end of the holder 73 with regard to the conveying direction. The inclined face 109 inclines to be closer to the resistance applier 121, i.e., downward, at the downstream side with regard to the conveying direction. Meanwhile, the resistance applier 121 has the rearward inclined face 125 at the rearward end being the upstream end of the resistance applier 121 with regard to the conveying direction. The rearward inclined face 125 inclines to be closer to the holder 73, i.e., upward, at the downstream side with regard to the conveying direction. Therefore, the leading portion of the sheet P may be directed to the lower side of the holder 73 and the upper side of the resistance applier 121 smoothly.

The directive guide 141 to contact the leftward edge of the sheet P and direct the sheet P rightward is arranged at the rearward position being the position upstream from the first inverting conveyer roller 61 along the conveying direction. The directive guide 141 has the directive wall section 142, which inclines rightward at the front being the downstream side with regard to the conveying direction. Therefore, when the sheet P is displaced leftward, the sheet P may be shifted rightward so that the widthwise position of the sheet P may be corrected before the sheet P is nipped by the first inverting conveyer roller 61. The sheet P at the correct widthwise position may be subject to the oblique conveying force that may shift the sheet leftward.

The first inverting conveyer roller 61 includes the driving roller 63 and the driven roller 64 having the shaft 105, which inclines with respect to the shaft 82 of the driving roller 63. Meanwhile, peaks in the holder 73 and the resistance applier 121 with regard to the vertical direction, i.e., the highest points in the holder 73 and the resistance applier 121, are arranged at the positions higher than the nipping point 108 between the driving roller 63 and the driven roller 64, i.e., on the same side with respect to the nipping point 108 as the driven roller 64 rather than the driving roller 63. Therefore, the position, at which the holder 73 and the resistance applier 121 may apply the conveying resistance to the sheet P, may be located to be higher than the nipping point 108, and the oblique conveying force to the sheet P may be increased.

Meanwhile, the holder 73 to hold the driven roller 64 may apply the conveying resistance to the sheet P. Therefore, compared to a hypothetical configuration, in which a member to apply the conveying resistance and the holder 73 are separated, the configuration in the inverting conveyer unit 71 may be less complicated.

More Example

Although an example of carrying out the invention has been described, those skilled in the art will appreciate that there are numerous variations and permutations of the sheet conveyer and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the first inverting conveyer roller 61 may not necessarily be arranged in the rear-leftward area in the inverting conveyer unit 71 while the regulative guide 131 may not necessarily be arranged at the position leftward from the first inverting conveyer roller 61. The regulative guide 131 may be arranged in the rear-leftward area in the inverting conveyer unit 71 while the first inverting conveyer roller 61 may be arranged at a position rightward from the widthwise center of the inverting conveyer unit 71. In this arrangement, the circumferential velocity of the driving roller 63 in the first inverting conveyer roller 61 may be set to be greater than the circumferential velocity of the driving roller 65 in the second inverting conveyer roller 62 so that the oblique conveying force to shift the sheet P to the regulative guide 131 may be increased.

For another example, the present disclosure may not necessarily be applied to the laser printer 1 but may be applied to another type of an image forming apparatus including, for example, an inkjet printer.

What is claimed is:

1. A sheet conveyer configured to shift a sheet being conveyed in a conveying direction sideward at one side of the sheet conveyer in a widthwise direction, the widthwise direction being orthogonal to the conveying direction, the sheet conveyer comprising:

a pair of rollers configured to nip the sheet and apply a conveying force to shift the sheet sideward to the sheet;

a regulative guide arranged at a position closer to the one side than the pair of rollers in the widthwise direction, the regulative guide extending in the conveying direction and being configured to contact an edge of the sheet closer to the one side in the widthwise direction to regulate a position of the edge;

a first guide arranged at a position upstream from the pair of rollers with regard to the conveying direction, the first guide being configured to contact a first area on a first face of the sheet at a position closer to the one side in the widthwise direction than a widthwise center of the sheet; and a second guide arranged at a position upstream from the pair of rollers with regard to the conveying direction, the second guide being configured to contact a second area on a second face of the sheet at a position closer to the one side in the widthwise direction than the widthwise center of the sheet, the second area being different from the first area in the widthwise direction, the second guide being arranged to partly overlap the first guide in a direction of height when viewed in the widthwise direction, the direction of height being orthogonal to the conveying direction and the widthwise direction.

2. The sheet conveyer according to claim 1, further comprising:

a curve guide arranged at a position upstream from the first guide and the second guide with regard to the conveying direction, the curve guide being configured to change a direction of a course to convey the sheet within the direction orthogonal to the widthwise direction.

3. The sheet conveyer according to claim 1, wherein the first guide and the second guide are arranged at positions displaced from the pair of rollers in the widthwise direction.

4. The sheet conveyer according to claim 1, wherein the first guide has a first inclined face at an upstream end thereof with regard to the conveying direction, the first inclined face inclining to be closer to the second guide in the direction of height at a downstream side with regard to the conveying direction; and wherein the second guide has a second inclined face at an upstream end thereof with regard to the conveying direction, the second inclined face inclining to be closer to the first guide in the direction of height at the downstream side with regard to the conveying direction.

5. The sheet conveyer according to claim 1, further comprising a directive guide arranged at a position upstream from the pair of rollers with regard to the conveying direction, the directive guide inclining to be closer to an other side of the sheet conveyer in the widthwise direction at a downstream side with regard to the conveying direction, the directive guide being configured to contact the edge of the sheet closer to the one side in the widthwise direction and guide the sheet toward the other side in the widthwise direction.

6. The sheet conveyer according to claim 1, wherein the pair of rollers include a driving roller and a driven roller, the driven roller comprising a rotation shaft, the rotation shaft of the driven roller inclining with respect to a rotation shaft of the driving roller; and wherein peaks in the first guide and the second guide in the direction of height are arranged at positions on a same side with respect to a nipping point between the driving roller and the driven roller as the driven roller.

7. The sheet conveyer according to claim 6, wherein the first guide is configured to hold the driven roller.

8. An image forming apparatus, comprising:

an image forming unit configured to form an image on a sheet being conveyed; and a sheet conveyer configured to convey the sheet in a conveying direction and shift the sheet being conveyed sideward at one side of the sheet conveyer in a widthwise direction, the widthwise direction being orthogonal to the conveying direction, the sheet conveyer comprising:

a pair of rollers configured to nip the sheet and apply a conveying force to shift the sheet sideward to the sheet;

a regulative guide arranged at a position closer to the one side than the pair of rollers in the widthwise direction, the regulative guide extending in the conveying direction and being configured to contact an edge of the sheet closer to the one side in the widthwise direction to regulate a position of the edge;

a first guide arranged at a position upstream from the pair of rollers with regard to the conveying direction, the first guide being configured to contact a first area on a first face of the sheet at a position closer to the one side in the widthwise direction than a widthwise center of the sheet; and a second guide arranged at a position upstream from the pair of rollers with regard to the conveying direction, the second guide being configured to contact a second area on a second face of the sheet at a position closer to the one side in the widthwise direction than the widthwise center of the sheet, the second area being different from the first area in the widthwise direction, the second guide being arranged to partly overlap the first guide in a direction of height when viewed in the widthwise direction, the direction of height being orthogonal to the conveying direction and the widthwise direction.

* * * * *